US007407005B2

(12) United States Patent
Zanca et al.

(10) Patent No.: US 7,407,005 B2
(45) Date of Patent: Aug. 5, 2008

(54) ELECTRICALLY CONTROLLED RELEASE DEVICE

(75) Inventors: Kevin Zanca, Sugar Land, TX (US); Ryan Daniel, Anchorage, AK (US); Todor K. Sheiretov, Houston, TX (US); Pete Howard, Bellville, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 270 days.

(21) Appl. No.: 11/150,042

(22) Filed: Jun. 10, 2005

(65) Prior Publication Data

US 2006/0278388 A1 Dec. 14, 2006

(51) Int. Cl.
*E21B 17/02* (2006.01)

(52) U.S. Cl. ..... 166/242.6; 166/377

(58) Field of Classification Search ..... 166/242.6, 166/377, 388

See application file for complete search history.

(56) References Cited

U.S. PATENT DOCUMENTS

| | | | | |
|---|---|---|---|---|
| 3,327,784 | A | 6/1967 | Pardue | 166/65 |
| 4,275,786 | A * | 6/1981 | Lee | 166/66 |
| 5,810,088 | A | 9/1998 | Lamirand et al. | 166/377 |
| 6,032,733 | A | 3/2000 | Ludwig et al. | 166/60 |
| 6,196,325 | B1 | 3/2001 | Connell et al. | 166/377 |
| 6,269,883 | B1 * | 8/2001 | Gissler et al. | 166/340 |
| 6,354,379 | B2 | 3/2002 | Miszewski et al. | 166/377 |
| 6,384,389 | B1 | 5/2002 | Spencer | 219/635 |
| 6,431,269 | B1 | 8/2002 | Post et al. | 166/65.1 |
| 6,545,221 | B1 | 4/2003 | Halpert et al. | 174/84 |
| 6,712,146 | B2 | 3/2004 | Estep et al. | 166/377 |
| 2002/0000320 | A1 | 1/2002 | Gissler | |

* cited by examiner

*Primary Examiner*—Jennifer H Gay
*Assistant Examiner*—Brad Harcourt
(74) *Attorney, Agent, or Firm*—Rodney Warfford; David Cate; Jaime Castano

(57) ABSTRACT

A cable release apparatus includes a housing and latch mounted at one end of the housing. The latch has a central opening and a plurality of projecting members extending into the housing. A releasable connector is mounted inside the housing. An actuator has one end disposed in the central opening in the latch and another end in contact with the releasable connector. The actuator is movable between a first position prior to activation of the releaseable connector and a second position wherein the releasable connector is activated. Prior to activation of the releasable connector, the latch is held in place by an interference fit between the projecting members and the housing. When the releasable connector is activated, the projecting members are deflected by applying tension to the latch, thereby releasing the latch from the housing.

20 Claims, 5 Drawing Sheets

ELECTRICALLY CONTROLLED RELEASE DEVICE

FIELD OF THE INVENTION

The invention relates to a downhole electrically controlled release device. The release device is adapted for releasing downhole apparatus such as a conveyance from a downhole tool or a portion of a tool string.

BACKGROUND

Various devices and methods have been provided in the oilfield service industry for releasing downhole apparatus such as wireline from the conveyance head and tools. Traditionally, such apparatus have relied upon mechanical weakpoints. U.S. Pat. No. 6,431,269, incorporated herein by reference, assigned to Schlumberger Technology Corporation addressed disadvantages and shortcomings of the prior art devices and methods.

Therefore, it is a desire to provide a release device that overcomes deficiencies of the prior art devices. It is a further desire, to provide a release device that provides additional benefits.

SUMMARY OF THE INVENTION

An embodiment of the present invention provide a device for releasably connecting downhole apparatus. The device comprises a housing; a latch mounted at one end of the housing having a central opening and a plurality of projecting members extending into the housing; an actuator having a first end disposed in the central opening; and a shape memory alloy member functionally connected to the actuator in a manner such that the actuator is held in a first position prior to activation of the shape memory alloy member and the actuator is moveable to a second position after the shape memory alloy member is activated. The latch is held in connection with the housing by an interference fit between the projecting members and the housing when the actuator is in the first position. The latch is disengaged from the housing when the actuator is in the second position.

Another embodiment of the present invention provides a device for releasably connecting a wireline to a downhole tool. In this embodiment, the device comprises a housing; a latch mounted at one end of the housing, the latch having a central opening and a plurality of projecting members extending into the housing; an actuator having a first end disposed in the central opening; and a shape memory alloy member positioned in parallel with the load path of the actuator and functionally connected to the actuator in a manner such that the actuator is held in a first position prior to activation of the shape memory alloy member and the actuator is moveable to a second position after the shape memory alloy member is activated. The projecting members have inner surfaces for engagement of an outer surface of the actuator, the inner surfaces of the projecting members and the outer surface of the actuator being substantially parallel to one another and the longitudinal axis of the actuator. The latch is held in connection with the housing by an interference fit between the projecting members and the housing when the actuator is in the first position, and wherein the latch is disengaged from the housing when the actuator is in the second position.

Another embodiment of the present invention provides a device for releasably connecting a conveyance to a downhole tool. In this embodiment, the device comprises a housing; a latch mounted at one end of the housing, the latch having a central opening and a plurality of projecting members extending into the housing; an actuator having a first end disposed in the central opening; and a releasable connector functionally connected to the actuator in a manner such that the actuator is held in a first position prior to activation of the releasable connector and the actuator is moveable to a second position after the releasable connector is activated. The projecting members have inner surfaces for engagement of an outer surface of the actuator, the inner surfaces of the projecting members and the outer surface of the actuator being substantially parallel to one another and the longitudinal axis of the actuator. The latch is held in connection with the housing by an interference fit between the projecting members and the housing when the actuator is in the first position, and wherein the latch is disengaged from the housing when the actuator is in the second position.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
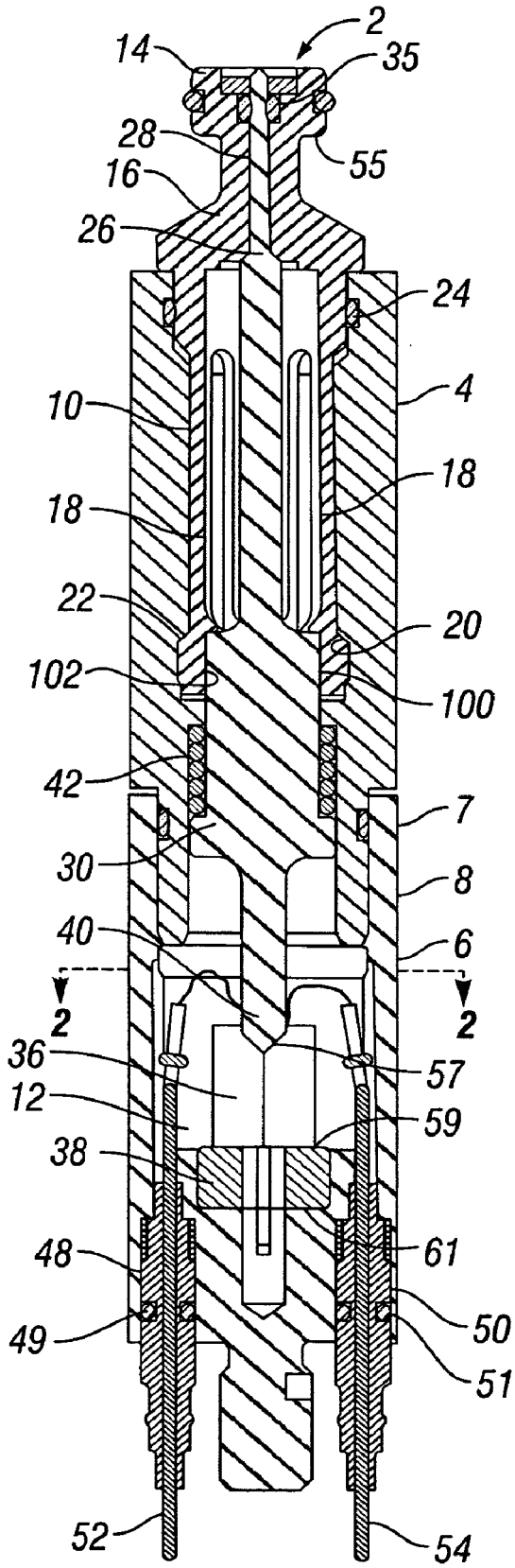
FIG. 1 is a cross-sectional view of an embodiment of the electrically controlled release device of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

The present invention provides an electrically controlled release device. It should be understood that the release device is equally applicable to releasing a conveyance from a downhole tool as it is to releasing a part of a tool string from the remainder of the tool string. However, for purposes of illustrating the principles of the release device, the release device will primarily be described as releasing a conveyance from a downhole tool.

The electrically controlled release device has two modes of operation. In the first mode of operation, the electrically controlled release device transmits the tension applied to the conveyance head (or tool head) by a conveyance to the downhole tools coupled to the conveyance head without releasing the conveyance from the conveyance head. In the second mode of operation, the electrically controlled device releases the conveyance from the conveyance head when a low tension is applied to the conveyance head. The electrically controlled release device can be activated to release the wireline cable regardless of the tensile load it is transmitting.

FIG. 1 is a cross-sectional view of an embodiment of the electrically controlled release device, generally denoted by the numeral 2, of the present invention. Release device 2 includes an upper housing body 4 and a lower housing body 6. Upper housing body 4 is coupled to lower housing body 6 by a threaded connection 8, for example. An O-ring 7 provides a seal between upper housing body 4 and lower housing body 6. Upper housing body 4 is provided with a central opening 10, and lower housing body 6 is provided with a central chamber 12.

A latch 14 is mounted on upper housing body 4. Latch 14 has a latching head 16 and fingers 18 which extend from latching head 16. Fingers 18 extend into central opening 10 of upper housing body 4. Fingers 18 have wedge-shaped surfaces 20 which are adapted to engage with a wedge-shaped surface 22 in the inner wall of the upper housing body 4. An O-ring 24 provides a seal between latching head 16 and upper housing body 4.

An actuator 26 is disposed within a central opening 28 in latch 14. A lower portion 30 of actuator 26 extends through upper housing body 4 into the central chamber 12 of lower housing body 6. Actuator 26 has an outer surface 100 substantially parallel to the longitudinal axis of actuator 26. Actuator surface 100 is adapted for engagement with the inner surface 102 of fingers 18. Inner finger surfaces 102 are substantially parallel to the longitudinal axis of actuator 26 and actuator outer surface 100. Co-owned U.S. Pat. No. 6,431,269 incorporated by reference herein, teaches that if surface 100 was parallel to the axis of release device 2 the frictional forces would prevent actuator 26 from moving when release device 2 was transmitting tension. The present invention teaches that actuator surface 100 being substantially parallel to the axis of release device 2 provides benefits and addresses disadvantages recognized in the prior release technology.

A first benefit of the inventive parallel actuator surface 100 and finger surfaces 102 is that the assembly of release device 2 is facilitated because the elements may be moved relative to each other to allow for tolerance. In the prior art invention, more precise control during assembly was required to ensure that loads would not be inadvertently translated to releasable connector 36. An additional benefit is that the release device of the present invention provides a safety feature to prevent accidental release of the carried tool at the surface. In the present invention release device 2 tends to self-lock when tension is applied to it. The weight of the tool string, when hanging in the derrick, creates sufficient tension to keep actuator 26 from moving even if release device 2 has been triggered to release. When release device 2 is lowered into the wellbore, the well pressure acts on latch 14 as a result of the pressure differential between the latch and the housing forcing the latch back into the housing, relieving any tension that may be present. In effect, the surface safety release is turned off when release device 2 is lowered in the wellbore.

Figure 2:
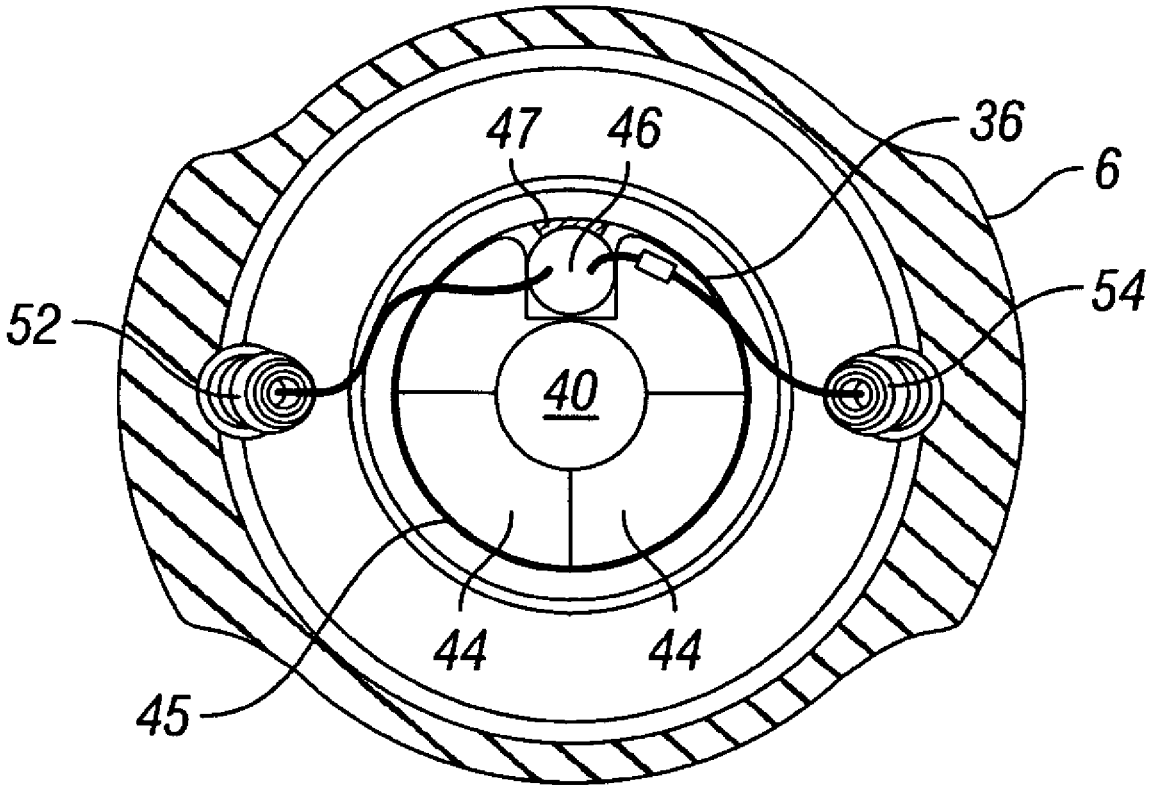
FIG. 2 is a cross-sectional view of the electrically controlled release device along the line 2-2 of FIG. 1.

Release device 2 includes a releasable connector 36 in functional connection with actuator 26 for triggering the device from mode 1 operation to mode 2. Releasable connector 36 is illustrated as a split bobbin assembly disposed in central chamber 12 of lower housing body 6. As shown in FIG. 2, split bobbin assembly 36 includes quartered bobbin pieces 44 and a resistive heater 46 arranged in a ring structure. Bobbin pieces 44 are preferably made of a heat-resistant material. A metal spring or coil 45 is tightly wound around bobbin pieces 44 and resistive heater 46 and soldered in place, as shown at solder joint 47. In this way, bobbin pieces 44 are held together. In one embodiment, metal spring 45 is made of a heat-resistant conductive material such as beryllium-nickel alloy. As will be further discussed below, the purpose of resistive heater 46 is to melt the solder joint 47 so that the metal spring 45 expands. When metal spring 45 expands, bobbin pieces 44 separate.

Returning to FIG. 1, lower housing body 6 includes two apertures 48, 50 for receiving insulating electrical feed-throughs 52, 54, respectively. O-rings 49, 51 provide seals between lower housing body 6, and feed-throughs 52, 54 respectively. Electrical feed-throughs 52, 54 provide the electrical current needed to power resistive heater 46 (shown in FIG. 2). A plate 38 made of insulating material is positioned between split bobbin assembly 36 and lower housing body 6. A nose portion 40 of actuator 26 is in contact with split bobbin assembly 36. A biasing mechanism 42, shown as a spring, disposed between actuator 26 and upper housing body 4 applies a biasing force to actuator 26, such that nose portion 40 of actuator 26 is held against bobbin pieces 44 (shown in FIG. 2) of split bobbin assembly 36.

Release device 2 has two modes of operation. In mode one, the release device transmits tension applied to latch 14 without fingers 18 separating from upper housing body 4. In mode two, fingers 18 can be separated from upper housing body 4 with a small tension applied to latch 14.

In mode one, a tensile load may be applied to latch 14 through surface 55 of latch 14. The tension applied to latch 14 is transmitted to upper housing body 4 through the interference fit of fingers 18 and housing 4 at surfaces 20, 22. The wedging effect of surfaces 20, 22 tends to cause fingers 18 to deflect, causing a compressive force to be applied to actuator 26 at surfaces 100, 102. This compressive force in addition to the force from the pressure differential between the wellbore and the housing maintains actuator 26 against split bobbin assembly 36. This compressive force is reacted by split bobbin assembly 36 and lower housing 6 and thus, latch 14 in connection with upper housing 4. As long as this compressive force is reacted, and actuator 26 remains in the first position, fingers 18 remain in connection with upper housing 4 via the interference fit.

In mode two, fingers 18 can be separated from upper housing body 4 with a small tension applied to latch 14. To switch release device 2 from mode one to mode two, a command is sent to a switching circuit (not shown) to power resistive heater 46 (shown in FIG. 2). The switching circuit (not shown) directs current to resistive heater 46 (shown in FIG. 2) through electrical feed-throughs 52, 54. Resistive heater 46 (shown in FIG. 2) melts solder joint 47 in metal spring 45, as previously described, thus allowing metal spring 45 to expand and bobbin pieces 44 to separate. The force which causes actuator 26 to move downward is provided by the compressive forces and biasing mechanism 42. In this state, the compressive loop described above can no longer be reacted and actuator 26 is moved to a second position. A small tension applied to upper housing body 4 will separate fingers 18 from upper housing body 4. Once fingers 18 disengage from upper housing body 4, latch 14 can be removed from release device 2.

Desirably, the seal provided by O-ring seal 35 is broken when bobbin pieces 44 separate and as actuator 26 moves downward. This allows release device 2 to be flooded with wellbore fluid so the pressure is equalized between the interior and the exterior of release device 2. This is necessary because the interior of release device 2 is initially at atmospheric pressure and release device 2 may need to be separated at ambient external pressures as high as 20,000 psi. If release device 2 were not pressure balanced, the pressure forces holding latch 14 and upper housing body 4 would be too great to allow fingers 18 to disengage from upper housing body 4. The flooding of release device 2 also provides additional force for moving actuator 26 downward.

Figure 3:
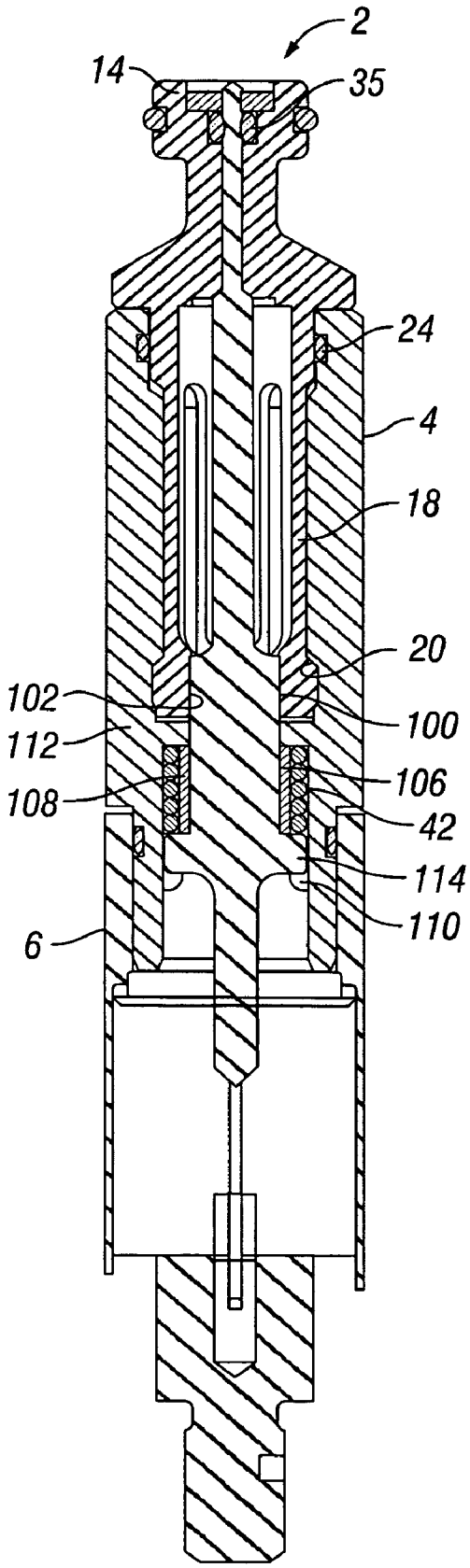
FIG. 3 is a cross-sectional view of another embodiment of the electrically controlled release device of the present invention.

FIG. 3 is a cross-sectional view of another embodiment of the electrically controlled release device, generally denoted by the numeral 2, of the present invention. Relief device 2 may include substantially parallel actuator outer surface 100 and finger inner surfaces 102 as illustrated or may include the wedged shaped actuator outer surface and finger inner surfaces as described in U.S. Pat. No. 6,431,269, which has been incorporated herein by reference.

As illustrated, bobbin assembly type releasable connector 36 of FIG. 1 has been eliminated and replaced with a sleeve assembly type releasable connector 104 functionally connected to actuator 26. This embodiment of the present invention isolates the transfer of any potential load to the releasable connector which increases the longevity of release device 2. Additionally, in installations wherein the tool string may include gun strings or other shock producing tools, a longer string may be utilized than with previous release devices.

Sleeve assembly 104 includes an expandable sleeve 106, a heater 108 and a releasable stop 110. Sleeve 106 of the present embodiment is a shaped memory alloy (SMA) that when heated elongates. Sleeve 106 is positioned in parallel with biasing mechanism 42 and the load path of actuator 26. Sleeve 106 is positioned between a lip 112 of housing 4 and a shelf 114 extending from actuator 26 in a manner such that when sleeve 106 is heated and elongates it urges actuator 26 downward. A stop 110 is positioned to maintain actuator 26 in a set and non-moving position in mode 1 operation. Releasable stop 110 may be, but is not limited to, a shear pins, a Truarc ring, a rupture disc, or a reusable mechanism such as a collet latch or press fit washer. Heater 108 is positioned in functional connection with sleeve 106. Operation of, and functional connections with, heater 108 are not provided herein as they are well known in the art and addressed in more detail in relation to FIG. 1.

In mode 1, fingers 18 are maintained in engagement with housing 4 by actuator 26 which is held in place by attachment of latch 14 to housing 4 and releasable stop 110. To release, heater 108 is activated heating sleeve 106 which elongates. The elongation of sleeve 106 results in breaking or separating releasable stop 110 releasing actuator 26 for movement. Biasing mechanism 42 will urge actuator 26 downward releasing fingers 18 from engagement with house 4. The movement of actuator 26 breaks seal 35 equalizing the pressure inside and out of release device 2 facilitating the removal of latch 14 from housing 4.

Figure 4:
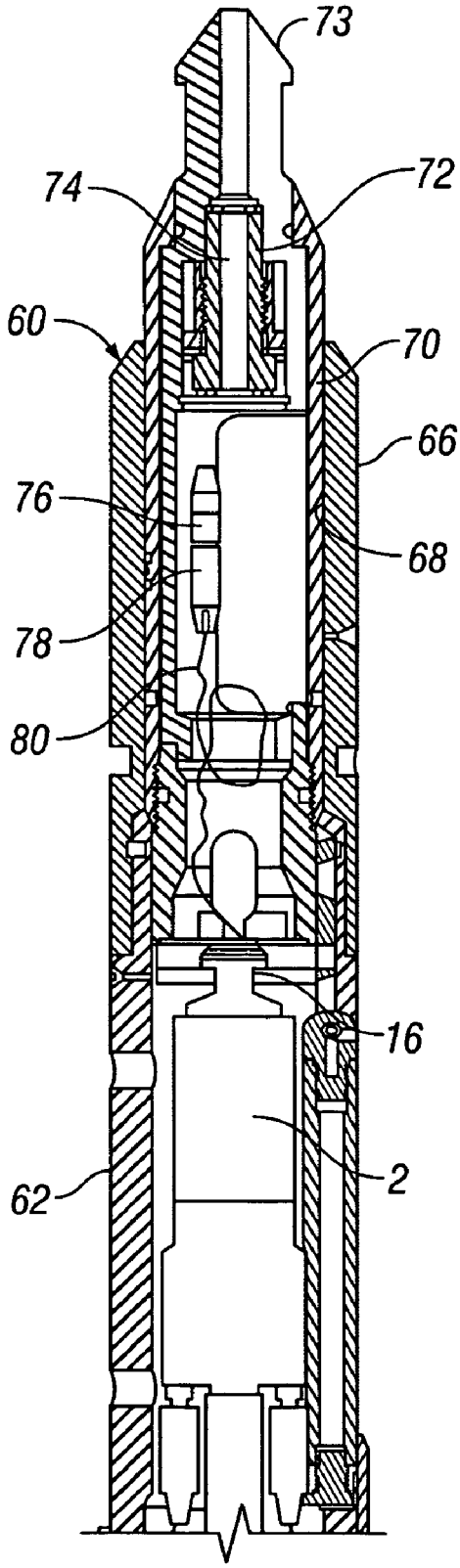
FIG. 4 is a cross-sectional view of a conveyance head of the present invention.

FIG. 4 is a cross-sectional view of a conveyance head 60. It should be noted that conveyance head 60 is not shown in its entirety to avoid obscuring the invention. In operation, the lower end of conveyance head 60 would be coupled to a logging tool assembly (not shown). Conveyance head 60 includes an outer housing 62. Release device 2 is mounted inside outer housing 62. A fishing neck 66 is mounted at the upper end of outer housing 62. Fishing neck 66 has a central bore 68 for receiving a shell 70. The lower end of shell 70 is secured to latching head 16 of release device 2. A housing 73 is attached to the upper end of shell 70. Inside housing 73 is a rope socket 72 which has an aperture 74 for receiving a wireline cable type conveyance (not shown). A conductor sleeve 76 is mounted inside shell 70. Conductor sleeve 76 connects the terminal ends of conductors in the wireline cable (not shown) to a connector 78 in shell 70. Connector 78 is in turn connected to the rest of the tool by electrical wiring 80. In this way, signals can be transmitted to and from the surface through the wireline cable (not shown).

Figure 5:
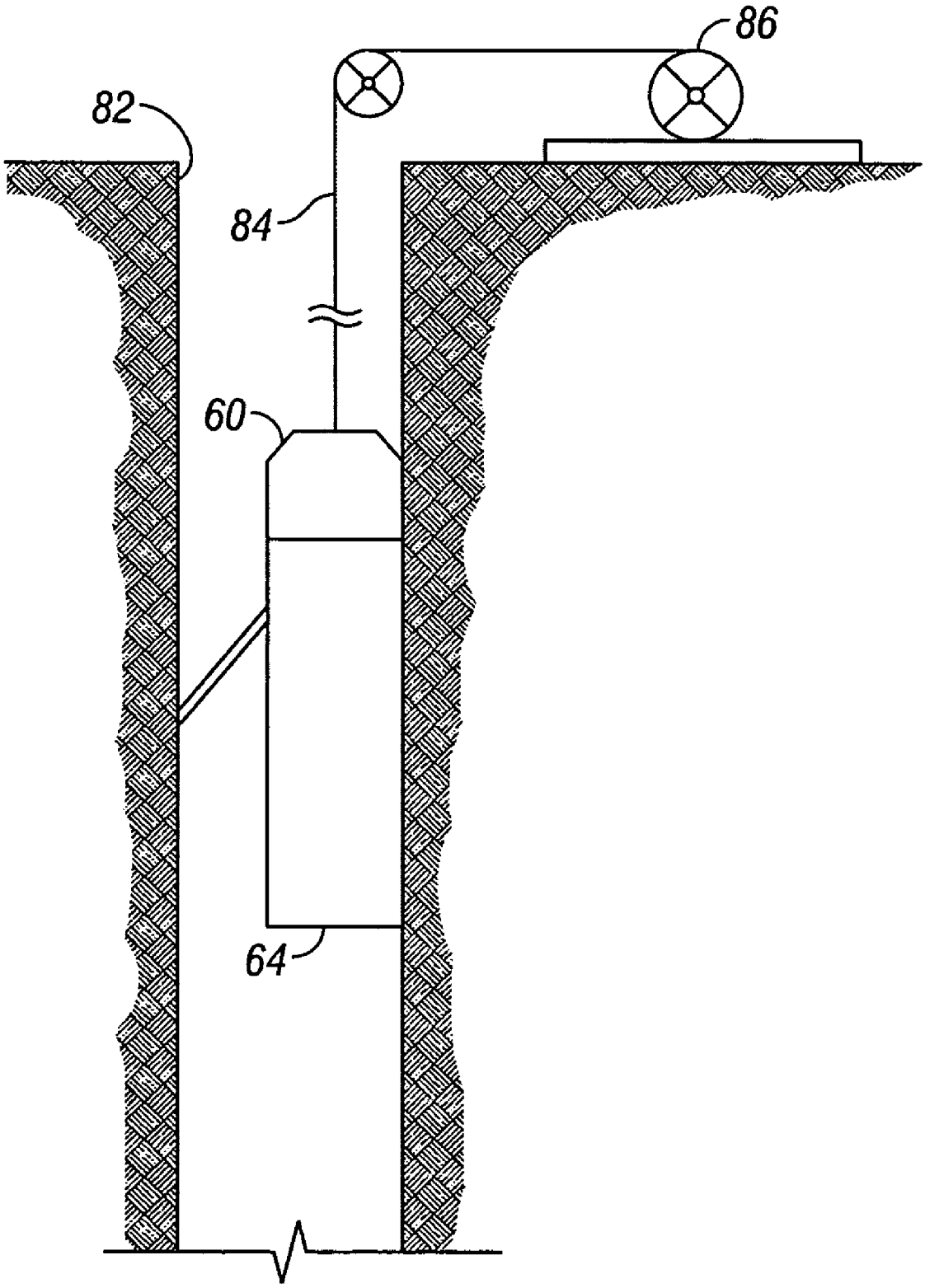
FIG. 5 is a cross-sectional view of a the present invention in a wellbore.

FIG. 5 is a schematic of an embodiment of the present invention in a wellbore in which the device is used to release a conveyance head 60 from a downhole tool assembly 64. Conveyance head 60 is suspended in a wellbore 82 on the end of a conveyance 84. Conveyance 84 is illustrated as a wireline cable, however, it should be recognized that other types of conveyances including, but not limited to, slick lines and coiled and non-coiled tubulars may be utilized. Wireline cable 84 is fed from a surface winch 86. In operation, tension from surface winch 86 is transmitted down to conveyance head 60 via wireline cable 84. The tension transmitted to conveyance head 60 is then transmitted to the downhole tool assembly 64 attached to conveyance head 60 through release device 2 (FIGS. 1 and 2) in conveyance head 60. During normal operations, release device 2 in conveyance head 60 is in mode one in which it will transmit high tensions without separating. When desired, release device 2 in conveyance head 60 is actuated to mode two and will separate with only a small tensile force applied to it.

From the foregoing detailed description of specific embodiments of the invention, it should be apparent that an electrically controlled release device that is novel and unobvious has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A device for releasably connecting a conveyance to a downhole tool, the device comprising:

a housing;

a latch mounted at one end of the housing, the latch having a central opening and a plurality of projecting members extending into the housing;

an actuator having a first end disposed in the central opening; and a shape memory alloy member functionally connected to the actuator in a manner such that the actuator is held in a first position prior to activation of the shape memory alloy member and the actuator is moveable to a second position after the shape memory alloy member is activated;

wherein the projecting members have inner surfaces for engagement of an outer surface of the actuator, the inner surfaces of the projecting members and the outer surface of the actuator being parallel to one another and the longitudinal axis of the actuator; and wherein the latch is held in connection with the housing by an interference fit between the projecting members and the housing when the actuator is in the first position, and wherein the latch is disengaged from the housing when the actuator is in the second position.

2. The device of claim 1, further including:

a biasing mechanism for applying a force to the actuator such that the actuator is moved toward the second position upon activation of the shape memory alloy member; and wherein the biasing mechanism is positioned in parallel with the shape memory alloy member.

3. The device of claim 1, further including:

a seal for sealing between the actuator and the latch, wherein the seal is configured to break as the actuator moves from the first position to the second position.

4. The device of claim 1, wherein the projecting members comprise inner wedged surfaces for engagement with an outer wedged surface of the actuator.

5. The device of claim 4, further including:

a seal for sealing between the actuator and the latch, wherein the seal is configured to break as the actuator moves from the first position to the second position.

6. The device of claim 5, further including:

a biasing mechanism for applying a force to the actuator such that the actuator is moved toward the second position upon activation of the shape memory alloy member.

7. A device for releasably connecting a wireline to a downhole tool, the device comprising:

a housing;

a latch mounted at one end of the housing, the latch having a central opening and a plurality of projecting members extending into the housing;

an actuator having a first end disposed in the central opening; and a shape memory alloy member positioned in parallel with the load path of the actuator and functionally connected to the actuator in a manner such that the actuator is held in a first position prior to activation of the shape memory alloy member and the actuator is moveable to a second position after the shape memory alloy member is activated;

wherein the projecting members have inner surfaces for engagement of an outer surface of the actuator, the inner surfaces of the projecting members and the outer surface of the actuator being parallel to one another and the longitudinal axis of the actuator; and wherein the latch is held in connection with the housing by an interference fit between the projecting members and the housing when the actuator is in the first position, and wherein the latch is disengaged from the housing when the actuator is in the second position.

8. The device of claim 7, further including:

a seal for sealing between the actuator and the latch, wherein the seal is configured to break as the actuator moves from the first position to the second position.

9. The device of claim 7, further including:

a biasing mechanism for applying a force to the actuator such that the actuator is moved toward the second position upon activation of the shape memory alloy member.

10. The device of claim 7, further including:

a biasing mechanism for applying a force to the actuator such that the actuator is moved toward the second position upon activation of the shape memory alloy member; and a seal for sealing between the actuator and the latch, wherein the seal is configured to break as the actuator moves from the first position to the second position.

11. A device for releasably connecting a conveyance to a downhole tool, the device comprising:

a housing;

a latch mounted at one end of the housing, the latch having a central opening and a plurality of projecting members extending into the housing;

an actuator having a first end disposed in the central opening; and a releasable connector functionally connected to the actuator in a manner such that the actuator is held in a first position prior to activation of the releasable connector and the actuator is moveable to a second position after the releasable connector is activated;

wherein the projecting members have inner surfaces for engagement of an outer surface of the actuator, the inner surfaces of the projecting members and the outer surface of the actuator being parallel to one another and the longitudinal axis of the actuator; and wherein the latch is held in connection with the housing by an interference fit between the projecting members and the housing when the actuator is in the first position, and wherein the latch is disengaged from the housing when the actuator is in the second position.

12. The device of claim 11, further including:

a biasing mechanism for applying a force to the actuator such that the actuator is moved toward the second position upon activation of the releasable connector.

13. The device of claim 11, further including:

a seal for sealing between the latch and the actuator; and a seal for sealing between the housing and the latch.

14. The device of claim 11, wherein the releasable connector is in contact with a second end of the actuator.

15. The device of claim 11, further including:

a seal for sealing between the actuator and the latch, wherein the seal is configured to break as the actuator moves from the first position to the second position.

16. The device of claim 11, wherein the releasable connector comprises a plurality of connector segments held together by a spring, and an electrically operated heater for melting a solder joint in the spring so as to enable expansion of the spring.

17. The device of claim 11, wherein:

the releasable connector is in contact with a second end of the actuator; and the releasable connector comprises a plurality of connector segments held together by a spring, and an electrically operated heater for melting a solder joint in the spring so as to enable expansion of the spring.

18. The device of claim 17, further including:

a biasing mechanism for applying a force to the actuator toward the releasable connector.

19. The device of claim 17, furthering including:

a seal for sealing between the latch and the housing; and a seal for sealing between the actuator and the latch, wherein the seal is configured to break as the actuator moves from the first position to the second position.

20. The device of claim 17, furthering including:

a biasing mechanism for applying a force to the actuator toward the releasable connector;

a seal for sealing between the latch and the housing; and a seal for sealing between the actuator and the latch, wherein the seal is configured to break as the actuator moves from the first position to the second position.

* * * * *